US006068493A

United States Patent [19]

Langridge

[11] Patent Number: 6,068,493

[45] Date of Patent: May 30, 2000

[54] ELECTRICAL CONNECTOR FOR FLEXIBLE FILM

[75] Inventor: Gary Langridge, St Albans, United Kingdom

[73] Assignee: The Whitaker Corporation, Wilmington, Del.

[21] Appl. No.: 09/170,001

[22] Filed: Oct. 13, 1998

[30] Foreign Application Priority Data

Oct. 22, 1997 [GB] United Kingdom ..... 9722330

[51] Int. Cl.[7] ..... H01R 12/00

[52] U.S. Cl. ..... 439/77

[58] Field of Search ..... 439/67, 77, 495, 439/465, 62; 361/749

[56] References Cited

U.S. PATENT DOCUMENTS

| | | | |
|---|---|---|---|
| 3,696,319 | 10/1972 | Olsson . | |
| 4,925,401 | 5/1990 | Fogg et al. | 439/465 |
| 5,240,420 | 8/1993 | Roberts | 439/62 |
| 5,266,048 | 11/1993 | Brekosky et al. | 439/470 |
| 5,507,651 | 4/1996 | Tanaka et al. | 439/67 |
| 5,839,917 | 11/1998 | Takahashi et al. | 439/495 |

FOREIGN PATENT DOCUMENTS 404087172 3/1992 Japan .

OTHER PUBLICATIONS

Search Report under Section 17, Application No. GB 9822530.3; Date of Search Feb. 24, 1999.

*Primary Examiner*—Neil Abrams
*Assistant Examiner*—Brian Webb

[57] ABSTRACT

Flexible film for a seat sensor is attached to a housing member in a cavity thereof. A terminal module is pluggably received in the cavity for rapid and simple plugging connection of the flex film to an electronics module.

7 Claims, 3 Drawing Sheets

ELECTRICAL CONNECTOR FOR FLEXIBLE FILM

BACKGROUND OF THE INVENTION

1. Field of the Invention

This invention relates to an electrical connector for interconnecting flexible film to complementary conductors.

2. Description of the Prior Art

Flexible circuits are used in a wide variety of applications. Flexible film typically comprises a thin flexible plastic substrate on which conductive circuit traces are plated, or otherwise deposited, for interconnecting electrical or electronic components. One particular application of flexible film, is as a sensor for detecting occupancy of a person on a support, such as the seat of an automobile. One particular construction involves a pair of sheets, or a single sheet folded into two halves in a back-to-back relationship where the conductive traces are on the outer faces of the folded sheets. The latter construction enables a large number of sensors to be positioned in a compact configuration. The sensors in the aforementioned application may be printed on the substrate, for example with resistive or capacitive properties depending on the tension exerted on the film. In many applications the film needs to be interconnected to a printed circuit board or other electronic circuitry that controls/processes the signals from the flexible film, for example the signals of the sensors.

It would be desirable to provide a compact, reliable and cost-effective interconnection between flexible film and further conductors. In view of the importance of reliability of electrical connection of sensor devices in automotive applications, a particularly robust and reliable electrical connection between flexible film and complementary conductors is desirable. Easy and rapid assembly of the interconnections would be desirable in view of reducing costs. In automotive applications where a thin film sensor is positioned in a seat for example, the manufacturing site of a seat is separate from that of the vehicle electronics and rapid interconnection is desirable during assembly of the automobile. It would also be advantageous to reduce the number of components, and in particular to provide a simple and effective interconnection between flexible film and electronic circuitry, for example on a printed circuit board, that processes the signals from the film sensors or other electronic devices.

SUMMARY OF THE INVENTION

An object of this invention is to provide a compact, reliable and easy to assemble connector for connecting flexible film to complementary conductors. It would be advantageous to provide a particularly compact connector for a pair of films, such as a single film folded into two halves or the like. It would be advantageous to enable rapid assembly of the film to electronic components such as a printed circuit board that processes the signals from the film.

Objects of this invention have been achieved by providing the connection assembly according to claim 1. Disclosed herein is an electrical connection assembly comprising a first housing member having a base wall and opposed top and bottom walls forming a cavity pluggably receiving a terminal module of the assembly, the terminal module comprising a second housing member and a plurality of electrical terminals lodged in the second housing member, each terminal having a contact section for biasing against circuit traces of a flexible film and a connection section for connection to a complementary conductor, wherein the first housing is adapted to receive, locate, and secure the flexible film within the cavity for pluggably receiving a contact section of the terminal module for connection of the terminals to the film. Advantageously therefore, the flexible film may be integrated in a device such as an automotive seat with the first housing member secured to a connection end of the flexible film, the terminal module being subsequently pluggable to the first housing member. Plugging may thus occur at a separate location in a rapid and simple manner, whereby the flexible film and first housing member can be easily integrated into other devices without the difficulty of integrating electrical connections at the same time. The connection assembly may further comprise a third housing member receiving electronic components therein connected directly to the terminal module such that the terminal module and third housing forms a component pluggable to the first housing member and flexible film. Particularly reliable, simple and compact interconnection of electronic control devices to flexible film devices is thus provided. Two sheets, or a folded single sheet of flexible film may be interconnected simultaneously by extension of the film along a top wall, respectively bottom wall of the first housing member whereby the terminal module is pluggably insertable between the two films. A particularly compact interconnection is thus provided.

Further advantageous aspects of this invention are set forth in the claims, or will be apparent from the following description and drawings.

DETAILED DESCRIPTION OF THE PREFERRED EMBODIMENT

Figure 1:
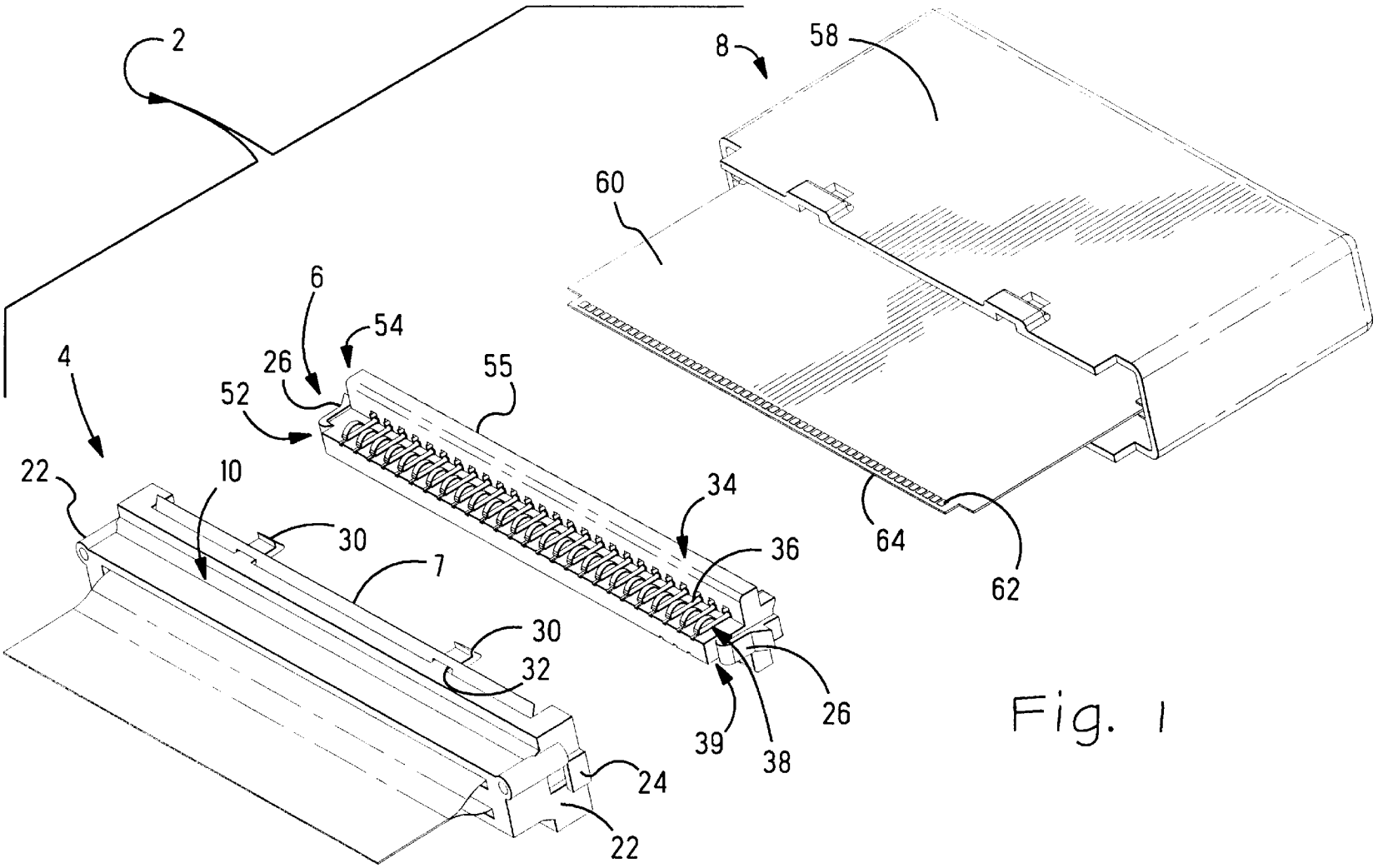
FIG. 1 is an exploded isometric view of a connection assembly according to this invention.
Figure 2:
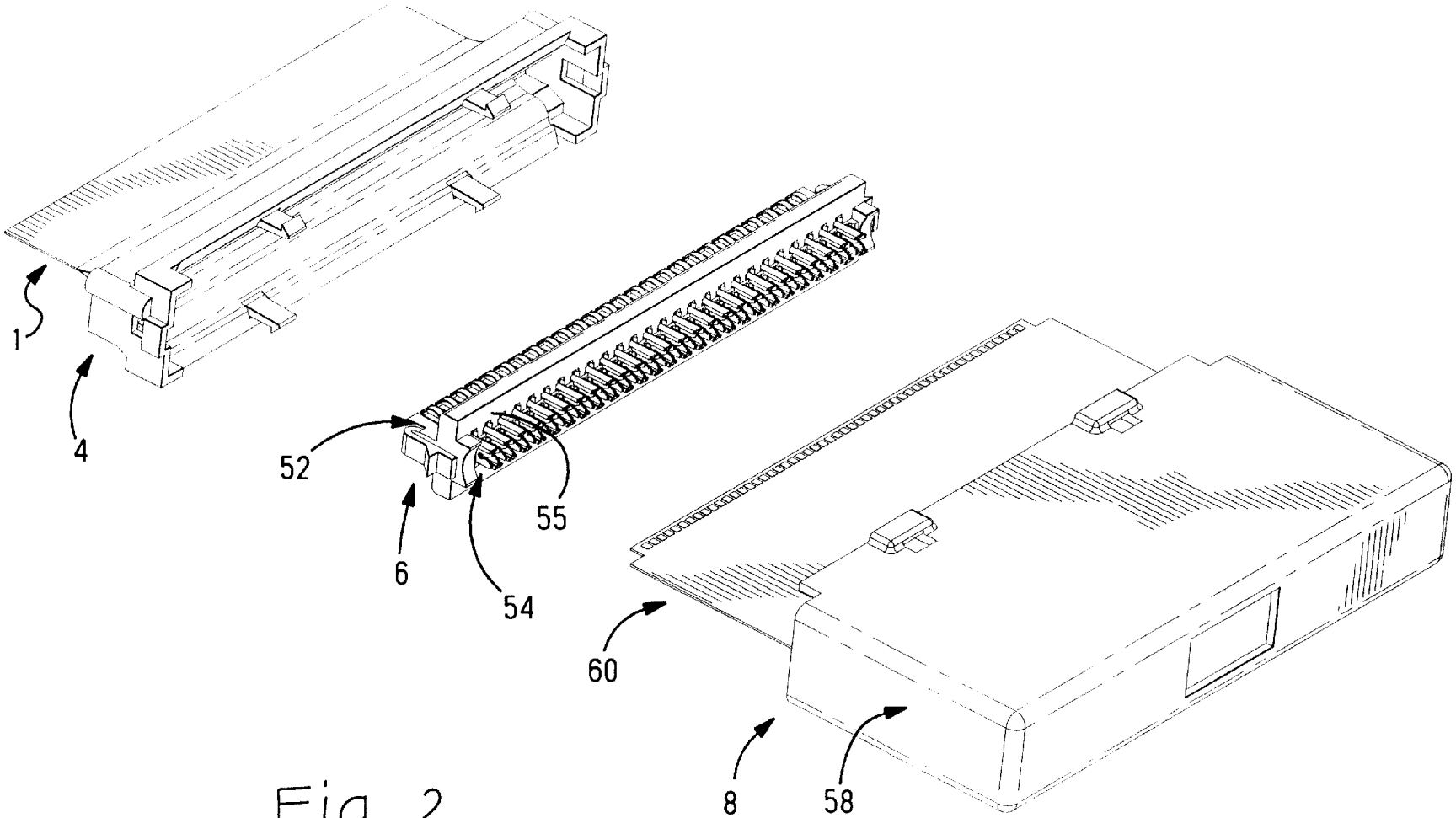
FIG. 2 is a view similar to that of FIG. 1 from a different angle.

Referring to the Figures, an electrical connection assembly 2 comprises a flexible film fixing module 4, a terminal module 6, and an electronics module 8. The flex film fixing module 4 comprises a first housing member 10 having a base wall 12 and opposed top and bottom walls 14,16 respectively extending from the base wall 12 to a plug receiving end 18, the walls forming a cavity 20 for pluggably receiving the terminal module 6. Opposed end walls 22 are provided with complementary latch members 24 for engaging latch members 26 of the terminal module 6. The latch members 26 are resilient latches for pluggably engaging and securing the terminal module 6 to the flex film fixing module 4. A flexible film 1 which is folded in a back-to-back relationship into a pair of films 3 can be pre-installed to the flex film fixing module 4 as shown in FIG. 1. Connection portions 5 of the films 3 are receivable through respective top and bottom passages 28 extending through the base wall 12, for insertion of the film connection portions 5 into the cavity 20 adjacent the top and bottom walls 14,16 respectively. Ends 7 of each film 3 are fixed to the first housing member 10 by fixing studs 30 extending integrally from the plugging ends 18 of the top and bottom walls and insertable through corresponding cutouts 32 at the ends of the film. The films 3 can thus be fed through the passages 28 and hooked onto the fixing studs 30 in a simple and rapid manner, ready for plugging reception of the terminal module 6. The film 1 can thus be installed in a device such as an automotive seat, for example by inmoulding in the foam cladding of the seat where the connection portions 5 project out of the device. Alternatively, the first housing member 10 can be fixed to the film 1 as shown in FIG. 1, and assembled to the device such as an automotive seat with the film. The first housing member 10 can thus be fixed to the device such that the electronics module 8 and terminal module 6 may be rapidly and easily assembled by plugging to the flex film fixing module 4.

The terminal module 6 comprises a second housing member 34 and a plurality of stamped and formed electrical terminals 36 mounted in the housing in a juxtaposed manner whereby the terminals are arranged in two rows 38,39 facing the top and bottom walls 14,16 respectively of the first housing member 10.

Figure 3:
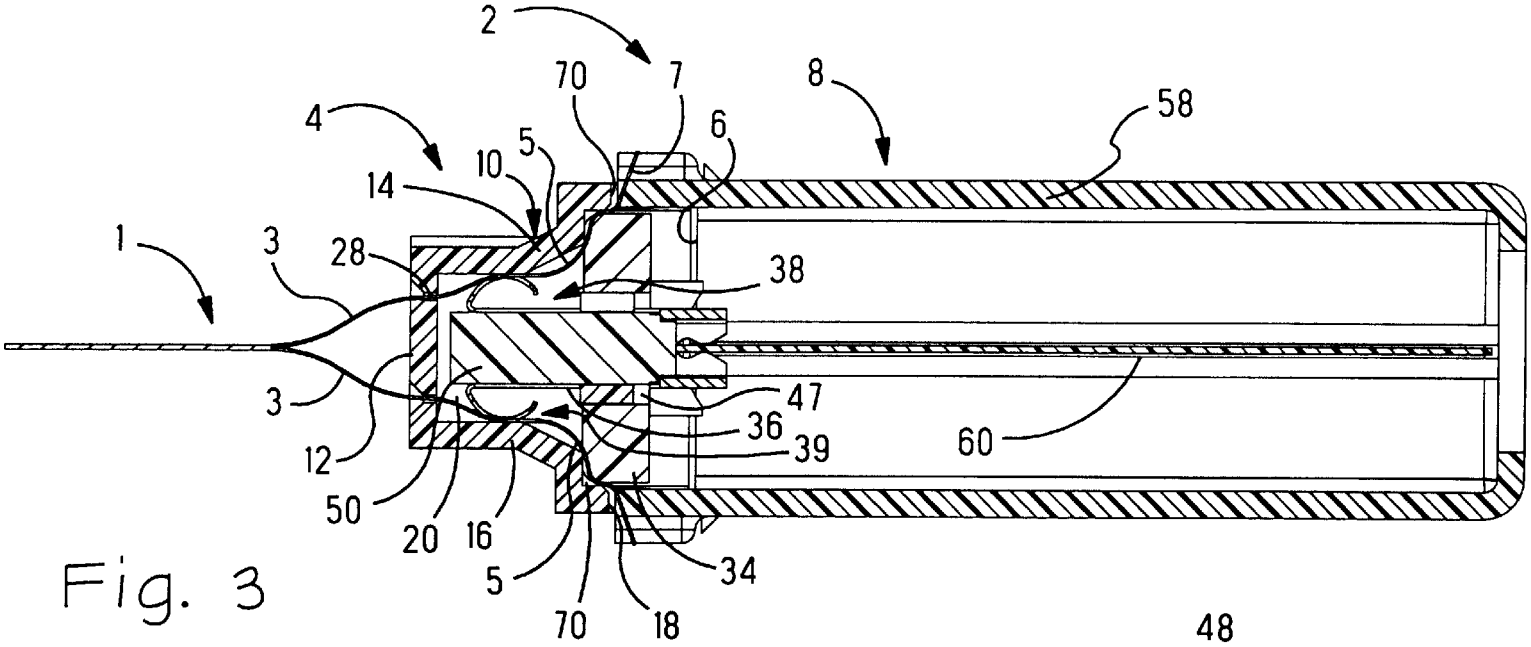
FIG. 3 is a cross-sectional view through a connection assembly according to this invention.
Figure 4:
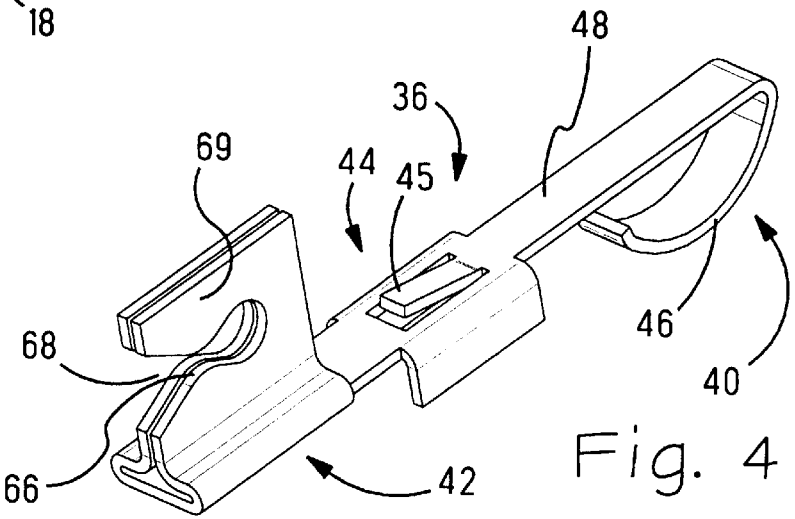
FIG. 4 is an isometric view of a terminal of the connection assembly.

Each terminal, as best seen in FIG. 4, comprises a contact portion 40, a connection portion 42, and a mounting portion 44 therebetween. The contact portion 40 comprises an arcuate spring contact 46 reversely folded over a base portion 48, the contact portion 46 for resiliently biasing against complementary conductive circuit traces on the connection portion 5 of the film 1. As best seen in FIG. 3, the contact portions 40 of terminals on the opposed rows 38,39 face in opposing directions and are resiliently biased towards each other by engagement with the opposed top and bottom walls 14,16 of the first housing member 10 as best seen in FIG. 3. The connection portions 5 of the films 3 are thus sandwiched between the contact portions 36 and the respective top and bottom walls 14,16 of the first housing member 10.

As best seen in FIG. 3, the base portions 48 of the contact sections 40 are received against a central support wall 50 of the terminal module. The central support wall 50 and the contact sections 40 form the contact section 52 of the terminal module 6. The terminal module also has a connection section 54 that incorporates an interface 55 for mounting with a third housing 58 of the electronic module 8, and the connection section 42 of the terminals that connect to electronics mounted in the third housing member 58. The electronics may for example be on a printed circuit board 60 having circuit traces 62 at an edge 64 thereof that plugs into contacts 66 of the connection section 42. The contacts 66 are formed by edge-stamping a substantially U-shaped cutout 68 out of the plane 69 of sheet metal from which the connection section 42 is formed, as best seen in FIG. 4.

The terminal module 6 may be fixed to the electronics module 8 by complementary latches or other fixing means such that the terminal module 6 and other electronics module 8 form a single unit, or alternatively the modules may be supplied as separate units assembled together at the desired location.

As terminals are provided in top and bottom rows 38,39 for connection to a pair of flex films 3 a particularly compact connection assembly is achieved. In addition rapid and reliable connection is possible at any desired location by simply plugging the terminal module 6 into the flex film fixing module 4.

The terminals 36 are mounted in the second housing 34 by means of resilient lances 45 stamped from the terminals that engage with corresponding shoulders in cavities 47 of the housing 34. The terminals 36 of the top and bottom rows are identical whereby the connection sections 42 are aligned such that the cutouts 68 and contact portions 66 thereof are aligned for plugging with a single printed circuit board edge 64. The latter is achieved by folding the connection portion plates 69 from the base 48 substantially perpendicular to the base 48 where the cutouts 68 are spaced from the base at a distance corresponding to substantially half the thickness of the terminal support wall 50 as best seen in FIG. 3.

As best seen in FIG. 3 when the terminal module 6 is plugged to the flex film fixing module 4, the module connection portion 55 bends the end of the flex film 7 in corners 70 at the plugging end of the first housing member 10. The kinking of the flex films 3 provides a more secure attachment to the connection assembly.

I/We claim:

1. Electrical connection assembly comprising a flexible film fixing module having a first housing member with a base wall and opposed top and bottom walls forming a cavity pluggably receiving a terminal module of the assembly, the terminal module comprising a second housing member and a plurality of electrical terminals lodged in the second housing member, each terminal having a contact section for biasing against circuit traces of a flexible film and a connection section for connection to a complementary conductor, wherein the first housing member is adapted to receive, locate, and secure the flexible film within the cavity, the first housing member pluggably receiving a contact section of the terminal module thereby connecting the terminals to the film.

2. The assembly of claim 1 wherein the first housing member is adapted to receive a pair of contact portions of the film, a first said contact portion locatable adjacent the top wall and a second said contact portion locatable adjacent the bottom wall whereby the terminal module is pluggable therebetween.

3. The assembly of claim 1 wherein the terminal module comprises at least two rows of contacts having contact portions facing in opposed directions for biasing against respective contact portions of a pair of films.

4. The assembly of claim 1 wherein the terminal module comprises a connection interface for securing to an electronics module.

5. The assembly of claim 4 wherein the connection sections of the terminals have contact portions adapted to engage an edge of a printed circuit board mounted in a housing of the electronics module.

6. The connector of claim 1 wherein the connection sections of the terminals comprise planar portions extending substantially orthogonally from a base portion of the terminal from which the contact sections are formed, the contact portion of the connection sections arranged at a distance from the base portion such that two rows of terminals mounted in a back-to-back relationship on the terminal module are provided with identical terminals.

7. The assembly of claim 1 wherein the terminals comprise resiliently biasable contact portions for resiliently compressing contact portions of the film against respective top and bottom walls of the first housing member.

* * * * *